United States Patent [19]

von Bonin et al.

[11] 3,985,929

[45] Oct. 12, 1976

[54] FABRIC FOR USE IN MAKING FOOTWEAR

[75] Inventors: Wulf von Bonin; Helmut Streigler, both of Leverkusen, Germany

[73] Assignee: Bayer Aktiengesellschaft, Leverkusen, Germany

[22] Filed: Nov. 1, 1974

[21] Appl. No.: 520,190

[30] Foreign Application Priority Data

Nov. 7, 1973 Germany ..... 2355537

[52] U.S. Cl. ..... 428/290; 427/243; 427/385 B; 427/407 C; 427/407 E; 427/407 G; 428/904

[51] Int. Cl.[2] ..... B32B 27/00

[58] Field of Search ..... 428/286, 290, 904; 427/243, 272, 385, 407

[56] References Cited

UNITED STATES PATENTS 3,632,417 4/1972 Brasen ..... 428/904

*Primary Examiner*—Marion E. McCamish
*Attorney, Agent, or Firm*—Frederick H. Colen; Lawrence S. Pope; Gene Harsh

[57] ABSTRACT

A non-woven fabric adapted for use in footwear is impregnated with a polymer prepared by polymerizing acrylic acid or methacrylic acid, mixtures thereof, or mixtures with other vinyl monomers in the presence of polyethylene oxide to improve its water absorption characteristics.

8 Claims, No Drawings

FABRIC FOR USE IN MAKING FOOTWEAR

This invention relates generally to a synthetic leather and more particularly to a novel and improved non-woven fabric adapted to be used in making footwear products such as shoes and the like.

Synthetic materials are replacing leather to an ever greater extent in footwear production. Not only the inside lining but also to an increasing degree the upper material of the shoe or the like is produced from synthetic fabrics.

Such materials when used in the footwear industry are mainly non-woven fabrics which are provided in addition with a top layer made from a suitable plastic, for example, polyvinylchloride or polyurethane. Footwear which is manufactured with such materials, often called synthetic leather, however, has one important deficiency. This is that the water absorption capacity of the heretofore available synthetic leather is not sufficient to insure that all the water resulting from perspiration of the foot is absorbed by the shoes, as a result of which the comfort of the wearer is seriously impaired.

Thus, there is a need for synthetic leather-substitutes which not only possess almost the same properties as leather with regard to technical features, such as strength, abrasion-resistance, bending and cracking resistance, but which also have the moisture storage capacity of leather.

Attempts have been made repeatedly to incorporate hydrophilic substances, natural or synthetic in the leather substitutes to increase the water storage capacity of synthetic leather. For example, polyvinyl alcohol, polymers with (optionally masked) hydrophilic groups such as sulphonic acid groups or carboxyl groups, cellulose and its derivates or polypeptides, such as gelatin have been used for this purpose. However, these processes, which are described, for example, in German OS 1,951,977; 1,811,593; 1,565,087; 2,043,452 and 1,904,348 and U.S. Pat. Nos. 3,482,283 and 3,575,753, have not been entirely successful because they have a number of other disadvantages of which the worst is the hard feel of the synthetic leathers heretofore produced. With many substances, such as, for example gelatin or cellulose derivatives, it is furthermore not possible to produce solutions of low viscosity with a solids concentration over 5%. For this reason, it is necessary to carry out impregnation of a fabric in several stages in order to incorporate a sufficient quantity of the hydrophilic agent.

It is therefore an object of this invention to provide a synthetic non-woven fabric which not only has a suitable feel, strength and flexibility but also has improved water absorption characteristics. Another object of the invention is to provide a novel and improved substitute for natural leather in the footwear industry. Still another object of the invention is to provide a process for making a fabric having improved water absorption characteristics for use in making footwear.

The foregoing objects and others are accomplished in accordance with this invention, generally speaking, by providing a synthetic non-woven fabric impregnated with a cross-linked polymer of acrylic acid or methacrylic acid in the presence of polyethylene oxide. It has now been found that synthetic non-woven fabrics with a moisture storage capacity, feel, strength and flexural behavior comparable to those of natural leather can be produced easily, if a polymer produced by polymerization of acrylic or methacrylic acid and, optionally, of other vinyl monomers in the presence of polyethylene oxide, is deposited in non-woven fabric whose fibers are initially bonded with synthetic rubber or other binding agents known per se.

The present invention therefor provides a process for the production of hydrophilic non-woven fabric to be used as a base material for synthetic leather wherein a non-woven fabric which has been initially bonded with a known binding agent is impregnated with a solution containing a polymer produced by polymerization of acrylic acid or methacrylic acid and optionally other vinyl monomers in the presence of polyethylene oxide, is thereafter dried and cross-linked by heat treatment. A cross-linking agent may be included in the solution.

The polymer to be used in accordance with the invention is preferably produced by radical polymerization of acrylic acid in the presence of polyethylene oxide at temperatures of 20° to 180° C, preferably 60° to 130° C. Other ethylenically unsaturated monomers may be used with acrylic acid, methacrylic acid or mixtures of acrylic or methacrylic acid, preferably water-soluble vinyl monomers, such as for example, acrylamide, methacrylamide, N-methylol acrylamide or methacrylamide and their methyl ethers, hydroxyl alkyl acrylates or methacrylates, acrylonitrile, vinyl sulphonic acid, acryloyl taurine, methacryloyl taurine, vinyl acetate, vinyl formate, allyl alcohol, maleic acid or maleic anhydride, maleic acid half-esters or fumaric acid half-esters such as monomethyl maleinate, dimethyl fumarate, maleimide, hydroxy ethyl maleimide or the like. These vinyl monomers to be used optionally in addition to acrylic or methacrylic acid should not amount to more than about 40% by weight of the monomer mixture, preferably less than 20%. It is considered particularly advantageous to use acrylic acid as the only vinyl monomer.

As starters for the polymerization of vinyl monomers there may be used the radical initiators of redox systems known per se, such as persulphates, persulphate-pyrosulphite, azo compounds such as azodiisobutyronitrile or peroxides such as for example benzoyl peroxide, lauroyl peroxide, t-butyl peroctoate or t-butyl hydro-peroxide.

The term "polyethylene oxide" as used herein is meant to include ethylene oxide polymers or oligomers which are soluble in water and whose molecular weight lies between approximately 90 and 20,000, preferably between 400 and 3000. Lesser amounts (up to approximately 30 % by weight) of other alkylene oxides, e.g. propylene oxide, may optionally be incorporated into the polyethylene oxides; however, oligomers and polymers of the ethylene oxide are preferably employed.

The production of these polyethylene oxides may be carried out according to processes known per se, for example, by the alkalicatalyzed addition of ethylene oxide to alcohols such as methanol, ethanol, butanol, glycol, propylene glycol, glycerine, trimethylol propane, triethanol amine, pentaerythritol, sorbitol or sugar.

Basic polyethylene oxides may be prepared by the addition of ethylene oxide to carboxylic acid or amines such as ammonia, ethylene diamine and the like. Depending upon the choice of starter, straight-chain or branched polyethylene oxides are obtained which in principle can all be employed in the process according to the invention. However, straight-chain polyethylene oxides are preferably used.

The polymer employed to impregnate the initially bonded non-woven fabric is most often used in the form of an aqueous solution. However, the use of aqueous-alcoholic solutions or solutions in alcohols, such as methanol, ethanol or isopropanol is also possible. The solids content of such solutions should be 3% to 80%, preferably 20% to 50% by weight.

In the production of the polymer to be used in accordance with the invention, the polyethylene oxide is put into a reaction vessel, a diluent such as water and/or alcohol, e.g. methanol, ethanol, or isopropanol, is then optionally added, which may simultaneously serve as a solvent for the polymer to be produced and the contents of the vessel are heated to the desired reaction temperature.

Acrylic acid or methacrylic acid, optionally in admixture with other vinyl monomers, and the polymerization initiator are then added batchwise or continuously and the mixture is stirred until completion of the polymerization. The resulting polymer solution can be used immediately for the process according to the invention or optionally after further dilution.

Under the above-described conditions there are probably produced mainly graft polymers in which acrylic acid, methacrylic acid or acrylic acid and additional vinyl monomers are grafted onto polyethylene oxide; however, the simultaneous presence of a homopolymer and polyethylene oxide in addition to the graft polymers cannot be ruled out with certainty. It should be pointed out that if the production of the polymer is carried out without polyethylene oxide and only in the presence of water, then polyacrylic acid solutions are always formed, whose viscosity is distinctly higher than if polyethylene oxides are employed and cannot be substantially reduced by the subsequent addition of polyethylene oxides.

Polymer solutions of low viscosity as required for industrial application and high solids content are only obtained if the polymerization of the vinyl monomers is carried out in the presence of polyethylene oxide.

The ratio of acrylic or methacrylic acid, or vinyl monomers in general, to polyethylene oxide may be varied but is preferably selected so that the polymers solids are from about 10% to about 75% by weight preferably about 25% to about 65% by weight of the polyvinyl compound. The polymers tend to cross-link of their own accord without added cross-linking agents at temperatures over 120° C, but additional cross-linking agents can be added, as a result of which the cross-linking temperature can be reduced to 50° C or lower or the degree of cross-linking is increased.

Non-woven fabrics suitable for the process in accordance with the invention are preferably manufactured from staple fibers; however, non-woven fabrics from continuous fibers, which are obtained by the spinning process can also be employed. As fiber material there may be used synthetic fibers, for example, from polyamide, polyester, polyolefin or polyacrylonitrile as well as fibers made from a regenerated, natural material, e.g. rayon or natural fibers such as wool, optionally blends of such fibers. In addition to the usual staple fibers, shrinkable fibers can be used, whose shrinkage is brought about by subsequent heat treatment, e.g. those based on polyester or polyacrylonitrile.

The production of non-woven fabric takes place according to dry or wet laying processes known per se and includes for example, the following steps:

a. carding, cross-laying, needling and optionally shrinking, if shrinkable fibers have also been used, or b. dispersing of the fibers, sheet forming and dewatering by suction; thereafter, the fibers are bound chemically and dried.

The chemical binding of the non-woven fabric may be carried out in a manner known per se by dipping the whole fabric in a bath containing an aqueous dispersion of plastics, for example, synthetic rubber dispersion, known per se and already used for practical purposes, based on NBR or SBR, and optionally heat sensitized, and thereafter by coagulation, washing, drying and vulcanization (NBR and SBR are synthetic rubbers based on copolymers of butadiene/acrylnitril and buttadiene/styrene, respectively). Bonding however, can also be achieved according to known methods by coagulating a polyurethane in the non-woven fabric.

The composition of the fibers, the spatial arrangement of the fibers in the non-woven fabric, the density and the type of the primary binding agent determine to a great extent the property pattern of the non-woven fabric. In particular, they determine the tensile strength, tear resistance, flexural behavior and rolling behavior and feel. The post-impregnation in accordance with the invention does not have a negative influence on these characteristics.

The strength properties of the material even increase and exceed those of leather in some cases. A further advantage of post-impregnation is that the usually undesirable rubberlike elasticity of the fabric becomes less pronounced and the springiness of the non-woven fabric is less marked.

The degree of cross-linking of the polymer to be used in accordance with the invention permits both hardness and moisture absorption to be controlled. Any suitable cross-linking agent may be used such as, for example, urea/formaldehyde condensates or melamine/formaldehyde condensates (also in the masked form, i.e. etherified form).

Other suitable cross-linking agents are e.g. phenol-formaldehyde pre-condensates; bisoxazolines; polymers, which contain N-methylol amide groups or etherified or esterified N-methylol amide groups; polyisonitriles, masked polyisocyanates and the like. Hexamethylol melamine pentamethyl ether is preferably used for cross-linking.

The cross-linking temperature is in general between 60° and 200° C, preferably between 110° and 150° C. The degree of cross-linking depends mainly on the quantity of cross-linking agent used. As little as 0.5% by weight of cross-linking agent based on the solids content makes the polymer insoluble in water. The capacity of a fabric produced from such a cross-linked polymer to absorb water can be over 3000%, i.e. upon storage in water at room temperature the fabric absorbs over 3000% of its own weight in water. If the film having been exposed to a temperature of 20° C and 65% relative humidity (standard atmosphere) is left for 24 hours at a temperature of 20° C in air having 85% relative humidity, it absorbs about 10% to 15% by weight of water vapor during this period. In the course of approximately 3 hours, this amount of absorbed moisture is given off again quantitatively, after the specimen has been returned to the standard atmosphere.

In the same way the moisture absorption of non-woven fabrics post-impregnated in accordance with the invention is reversible. If the degree of cross-linking is raised by adding more cross-linking agent, the moisture absorption capacity of the non-woven fabric falls somewhat, while at the same time the material becomes stiffer. It is therefore possible to use the same non-woven fabric either to produce footwear uppers or to produce stiff materials which can be used as reinforcing materials for footwear uppers for the second of which purposes more cross-linking agent or more of the polymer according to the invention must be used. In general 0.1% to 10% by weight, preferably 0.5% to 5% by weight of the cross-linking agents calculated on the polymer solids is added to the polymer solution to be used in accordance with the invention. The ability of non-woven fabrics, which have been kept in a standard atmosphere of 20° C and 65% relative humidity, to absorb moisture in a chamber having a temperature of 20° C and a relative humidity of 86% can be increased to approximately 5% in 24 hours by applying about 50% by weight of a polymer according to the invention. Larger amounts of the polymer can be incorporated by repeating the impregnation procedure, but this substantially changes the feel of the synthetic leather in ways which are not generally desirable. Any amount of the polymer of the invention will cause some improvement in the water absorption characteristics so in its broadest aspects the invention contemplates fabrics adapted to be used in making footwear containing any amount of the polymer. It is preferred that the impregnated fabric contain from about 5 to about 50 percent by weight of the polymer, based on the weight of the final product.

When being used for the production of footwear uppers, the products usually are coated with synthetic coating materials known per se, preferably PVC or polyurethanes. The coatings are preferably microporous and may be prepared either by applying polymer solutions (U.S. Pat. Nos. 3,575,894 and 3,553,008) or reactive systems (U.S. Pat. Nos. 3,625,871, 3,789,027, 3,646,178, 3,692,570, 3,788,887 and 3,769,381).

EXAMPLES

Production of the Polymer Solutions 300 parts of the polyethylene oxide are heated with 300 parts of water to 90° C. A solution of 1% by weight of t-butylperoctoate in the particular amount of acrylic acid used is then mixed over the course of approximately 45 minutes with the aqueous polyethylene oxide. Thereafter, the mixture is stirred for a further 5 hours at 90° to 110° C and then diluted with an amount of water whose weight is equal to that of the acrylic acid used. After cooling a ready-for-use 50% polymer solution is obtained, which can be optionally further diluted with water.

In accordance with these general directions, polymer solutions are produced from the following starting components:

A. polyethylene oxide, molecular weight 600, started on ethylene glycol; 300 parts of acrylic acid.

B. polyethylene oxide, molecular weight approximately 300, started on ethylene glycol; 300 parts of acrylic acid.

C. polyethylene oxide, molecular weight approximately 1550, started on ethylene glycol; 300 parts of acrylic acid.

D. polyethylene oxide, molecular weight approximately 2000, started on triethanol amine; 300 parts of acrylic acid.

E. polyethylene oxide, molecular weight approximately 1500, started on ethanol; 200 parts of acrylic acid.

F. polyethylene oxide, molecular weight 200, started on propylene glycol-1,2; 400 parts of a mixture of 10% by weight of vinyl acetate, 15% by weight of methacrylic acid and 75% by weight of acrylic acid.

1. A non-woven fabric for use in making synthetic leather consisting of 40% polyamide fibers 1.6/40, 35% polyester fibers (shrinkable) 1.2/60, 25% rayon fibers 1.7/40 bonded with an NBR latex with 48% of a binding agent in the non-woven fabric is split and buffed. The non-woven fabric is impregnated with a 25% aqueous solution of polymer (A) which contains in addition 1%, based on the polymers solids, of a cross-linking agent, the pentamethyl ether of hexamethylol melamine.

After removing excess polymer solution by squeezing, then drying and condensing, a soft, microporous non-woven fabric is obtained suitable for footwear linings. The non-woven fabric contains about 25% by weight of polymer (A). The moisture absorption of the non-woven fabric after it has been saturated with water in the standard atmosphere (20° C/65% relative humidity) is 4.6% after 24 hours in a chamber having 86% relative humidity and a temperature of 20° C. Split leather exposed to the same conditions absorbs 5% moisture. The moisture absorption of a non-woven fabric which has not been impregnated with polymer is 0.4% under the same conditions. Non-woven fabrics exhibiting equally good moisture absorption are also produced when using the polymers (B), (E) and (F).

2. A polyurethane film is bonded to the surface of the microporous non-woven fabric containing polmer (A) obtained in Example 1.

The polyurethane film is produced according to Example 1 of U.S. Pat. No. 3,575,894 by coagulation of a 22% dimethylformamide solution of an elastomer from an ethylene glycol-butanediol-adipic acid polyester (OH number 56), di-phenyl methane diisocyanate and carbodihydrazide in water.

The absolute value of the moisture absorption of the non-woven fabric expressed in milligrams of the water absorbed is not impaired by the presence of the polymer film. The material can be used for uppers in the production of shoes and boots.

3. The non-woven fabric used in Example 1 is impregnated with a 20% aqueous solution of polymer (C) with the addition of 5% of the cross-linking agent employed in Example 1, freed of excess solution by squeezing, dried and condensed for 10 minutes at 150° C. 24% of solids based on the total weight of the non-woven fabric become impregnated in the fabric. The resulting non-woven fabric has a harder feel than that of the non-woven fabric in Example 1 and can be used for upper reinforcements in the production of shoes. The moisture absorption of the non-woven fabric, having been saturated in the standard atmosphere (20° C/65% relative humidity) is 2.5% after 6 hours in a chamber having 86% relative humidity and a temperature of 20° C.

4. The non-woven fabric used in Example 1 is impregnated with a 25% aqueous solution of the polymer (D), freed of excess polymer solution by squeezing between two rollers, dried and condensed for 5 minutes at 140° C. The amount of polymer incorporated in the fabric is 34%. Measurement of the moisture absorption according to Example 1 yields a value of 4.9%. The feel of the non-woven fabric has not become substantially harder after treatment in accordance with the invention despite the relatively high total polymer content.

What is claimed is:

1. A process for the production of hydrophilic non-woven fabric adapted to be a base material for synthetic leather which comprises impregnating a non-woven fabric with a polymer and optionally a cross-linking agent, said polymer having been produced by polymerization of ethylenically unsaturated monomers including acrylic acid or methacrylic acid in the presence of polyethylene oxide, drying the resulting impregnated fabric, and optionally heating to cross-link the polymer.

2. The process of claim 1, wherein the initially bonded non-woven fabric is impregnated with an aqueous solution containing a polymer produced by radical polymerization of acrylic acid in the presence of polyethylene oxide with a molecular weight between 400 and 3000.

3. The process of claim 1, wherein hexamethylol melamine pentamethyl ether is mixed with the polymer as an additional cross-linking agent.

4. A non-woven fabric impregnated with a polymer prepared by polymerizing acrylic acid or methacrylic acid while mixed with polyethylene oxide.

5. The fabric of claim 4, wherein the polymer is prepared by polymerizing acrylic acid or methacrylic acid and an ethylenically unsaturated monomer mixed with polyethylene oxide.

6. The fabric of claim 4 coated with polyvinyl chloride or a polyurethane.

7. A shoe or boot lined with the fabric of claim 4.

8. The process of claim 1, wherein the polymer is produced by polymerization of acrylic acid or methacrylic acid with an ethylenically unsaturated monomer in the presence of polyethylene oxide.

* * * * *